US008590257B2

(12) United States Patent
Yurko, Sr.

(10) Patent No.: US 8,590,257 B2
(45) Date of Patent: Nov. 26, 2013

(54) METAL STUD ROOF DEFLECTION CLIP

(76) Inventor: Robert A. Yurko, Sr., Brooklyn, OH (US)

( * ) Notice: Subject to any disclaimer, the term of this patent is extended or adjusted under 35 U.S.C. 154(b) by 0 days.

(21) Appl. No.: 13/134,220

(22) Filed: Jun. 2, 2011

(65) Prior Publication Data

US 2012/0304583 A1 Dec. 6, 2012

(51) Int. Cl.
*E04B 1/38* (2006.01)
*E04C 5/00* (2006.01)

(52) U.S. Cl.
USPC ..... 52/715; 52/656.1; 52/712; 52/489.1; 52/489.2

(58) Field of Classification Search
USPC ..... 52/712, 715, 713, 481.1, 482, 655.1, 52/714, 656.9, 489.1, 489.2; 403/403; 24/336
See application file for complete search history.

(56) References Cited

U.S. PATENT DOCUMENTS 2,711,876 A * 6/1955 Goebel ..... 248/343
3,461,638 A * 8/1969 Balinski ..... 52/483.1
3,589,660 A * 6/1971 Dunckel ..... 248/343
4,056,904 A * 11/1977 Dawdy ..... 52/127.3
4,194,336 A * 3/1980 Weinar ..... 52/481.1
4,805,364 A * 2/1989 Smolik ..... 52/241
4,854,096 A * 8/1989 Smolik ..... 52/241
4,908,915 A * 3/1990 Ruggles et al. ..... 24/336
5,060,434 A * 10/1991 Allison ..... 52/238.1
5,325,651 A * 7/1994 Meyer et al. ..... 52/715
5,394,665 A * 3/1995 Johnson ..... 52/241
5,664,392 A * 9/1997 Mucha ..... 52/715
5,720,138 A * 2/1998 Johnson ..... 52/220.7
5,720,571 A * 2/1998 Frobosilo et al. ..... 403/403
5,966,893 A * 10/1999 Quillin ..... 52/713
6,213,679 B1 * 4/2001 Frobosilo et al. ..... 403/403
6,792,733 B2 * 9/2004 Wheeler et al. ..... 52/656.1

* cited by examiner

*Primary Examiner* — Chi Q Nguyen
(74) *Attorney, Agent, or Firm* — Emerson Thomson Bennett; Roger D. Emerson; Sergey Vernyuk

(57) ABSTRACT

An improved deflection clip for connecting metal stud walls to a structural building member, which accommodates relative compensating vertical movement, is disclosed. Some embodiments of the present invention allow for the deflection mounting clip to be set into place by metal barbs, eliminating the need for screwing the stud to the ceiling track runner, then subsequently removing the screws when the wallboard is installed. A deflection clip in accordance with the present invention has a flat base with left and right flanges substantially perpendicular to the base. Each flange has a number of triangular barbs facing externally to secure the deflection clip to the track without the need for temporary fixation.

8 Claims, 2 Drawing Sheets

METAL STUD ROOF DEFLECTION CLIP

FIELD OF INVENTION

The present invention relates in general to deflection clips used in construction, and in particular to interior construction to secure an interior wall framing stud to the top appropriated ceiling track.

BACKGROUND OF INVENTION

Deflection tracks and clips are two of the many construction elements common to metal stud framing. A deflection track assembly is part of a wall construction assembly and is used to accommodate the expected vertical movement (deflection) of the structure without damage to the wall finish and system assembly.

In a deep leg track system, the vertical studs are temporarily fastened into place by screwing the stud to the deflection clip. These screws must be removed prior to installing the wallboard for deflection to occur without damaging the wall.

Light gauge metal stud framing can be labor-intensive in comparison to the low cost of the materials. It is estimated that approximately 60% of the metal studs used in the United States are for interior non-structural wall partitions.

Deflection clips are used to attach the exterior curtain wall studs to the building structure and provide for vertical building movement independent of the framing. These clips slide in the vertical direction. A clip only supports the stud in the horizontal direction. Unless a stud is designed to take vertical load, it will deflect or buckle under compression and fail. The slide created by deflection clips guards against incidental bearing loads.

Deflection dies have been utilized in interior construction of partitions in commercial and residential spaces. Traditionally, there is a floor track which is an upward-opening channel on the floor and an overhead track which is a downward-opening track on the ceiling. Metal studs are inserted into the track at specified spacings. The studs are then secured to the tracks with various types of attachments generally referred to as deflection clips.

In the prior art, various deflection clips have been suggested. However, these deflection clips require fastening the stud to the ceiling track, then subsequently removing the fastener prior to installing the wallboard. This process is time-consuming and labor-intensive. It can be seen, then, that there is a need for a deflection clip that, when engaged with the stud, does not require temporary attachment of the stud to the ceiling track runner while still allowing the ceiling track and deflection clip to slide on the stud as increased roof loads occur.

SUMMARY OF INVENTION

To minimize the limitation in the prior art, the present invention discloses a deflection clip for use in the erection of interior partitions. The deflection clip has a base that is substantially flat and substantially rectangular-shaped. The base has an inside surface, an outside surface, a left end portion, and a right end portion. The left and right end portions each have an extension that is substantially perpendicular to the base. Each extension has an inside and outside surface. Each extension is integrally formed with the base. On the outside surface of each extension, a flange extends from the inferior surface externally. Each flange contains at least one substantially triangular shaped barb cut from the flange. Each barb extends outward by leaving the superior portion of the barb connected to the flange.

The deflection clip secures a stud positioned between the open channel tracks which are affixed to the floor and ceiling. The open channel tracks are C-shaped with a base and two legs extending perpendicular to the base. The C shaped open channel allows a stud to be placed therein. The stud rests in the base of the floor track and is short of touching the base of the ceiling track. This gap allows the ceiling to move up and down without transferring loads to the stud. The deflection clip secures the stud from moving along the longitudinal length of the open channel tracks. The deflection clip is fastened into place in the top track using the barbs. The stud in then inserted into the clip without fastening the stud to the clip or top track. The deflection clip and top track can then slide on the stud as required due to changes in vertical loads.

In one embodiment, the deflection clip is made from light gauge steel that is sufficiently resilient allowing the clip to be simply tapped into place. This eliminates the requirement for fasteners to secure the clip in place. Eliminating the use of fasteners helps to eliminate drywall bulge created by screw attachments to the stud. Alternatively, the present invention eliminates the labor required to screw the deflection clips into place, then remove the screws prior to drywall installation. The deflection clip may be used in either the floor or the ceiling track.

DETAILED DESCRIPTION OF INVENTION

Figure 1:
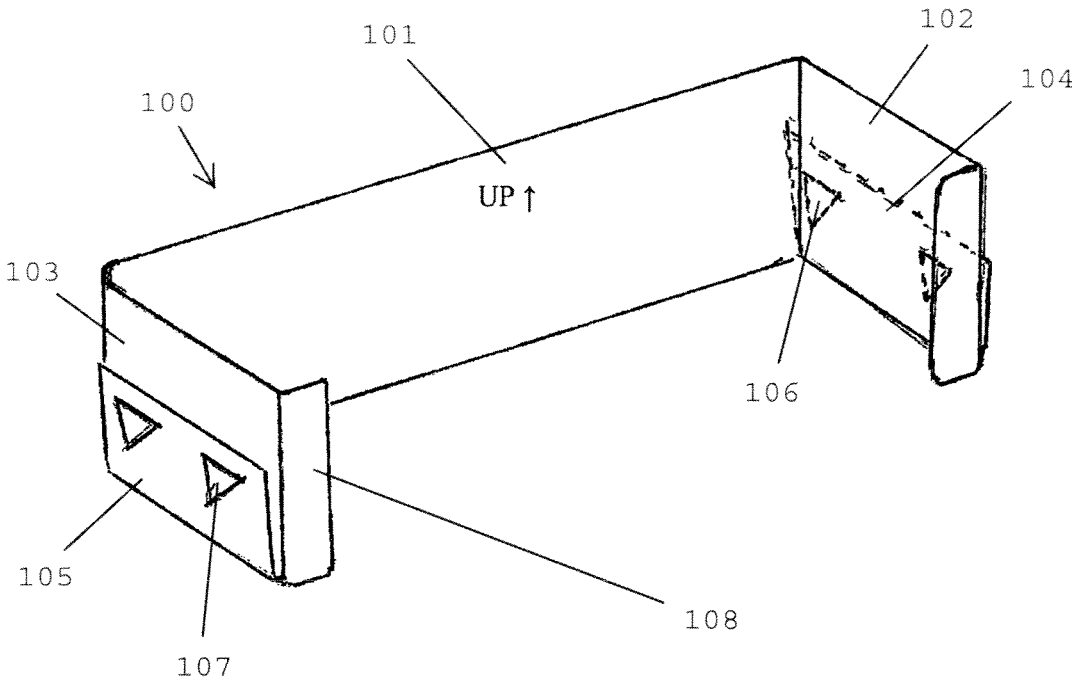
FIG. 1 is an isometric view of the deflection clip.
Figure 2:
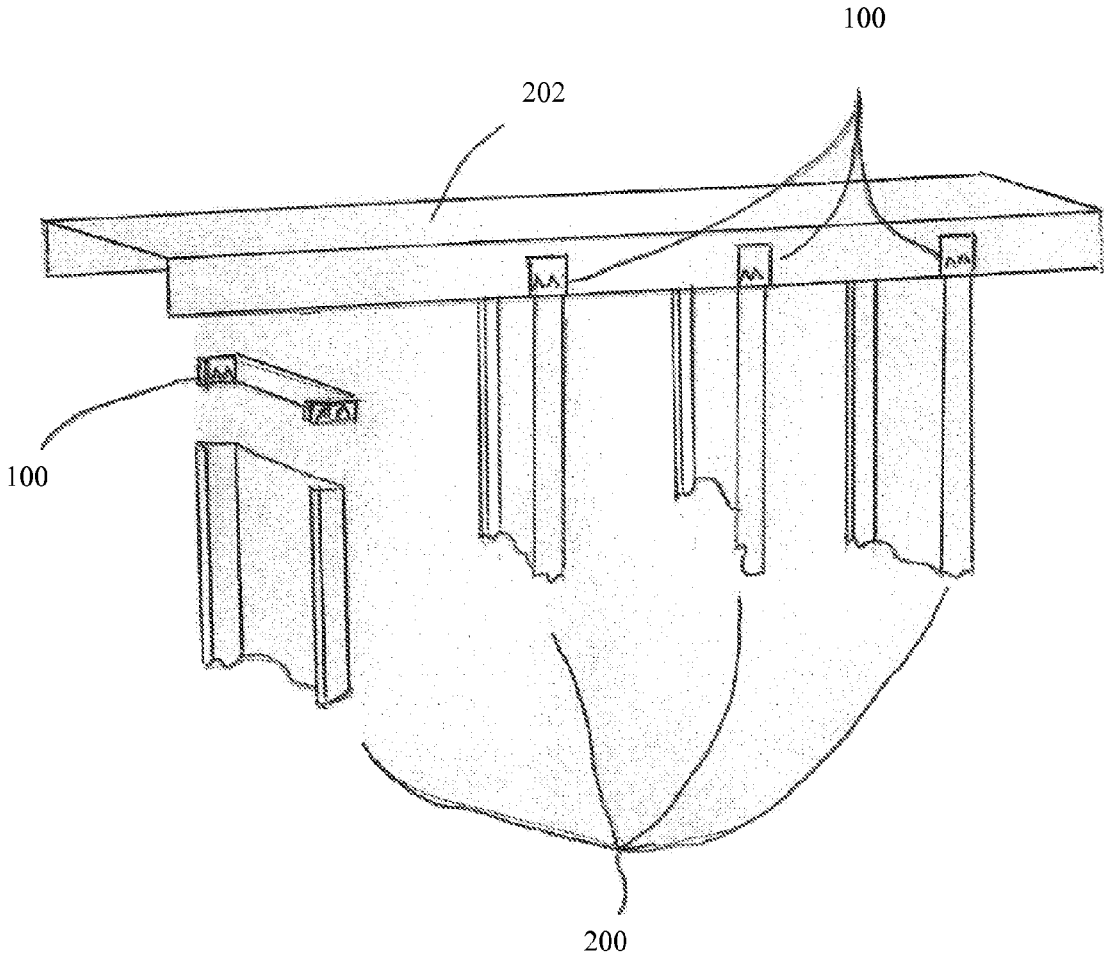
FIG. 2 is a perspective veiw of a track, studs, and deflection clips.

FIG. 1 is an isometric view of a deflection clip 100 (or "clip" 100) constructed in accordance with an embodiment of the present invention. Generally, a clip constructed in accordance with the present invention, such as clip 100, has a flat base 101 and perpendicular extensions or end portions 102, 103 to adequately engage the operative sliding function. In this arrangement, the desired deflection typically occurs along the longitudinal axis of the clip 100.

The clip 100 comprises a planar base 101 and perpendicular end portions 102, 103 that create a C-channel for engagement of structural members or studs 200. The end portions 102, 103 further have a resiliently-deformable flange 104, 105 that extends upwardly and outwardly from the bottom of the end portions 102, 103. Each flange 104, 105 has at least one barb 106, 107 extending outward from the flange 104, 105. This configuration allows the clip 100 to be fastened to the ceiling track 202 with the barbs 106, 107 thus eliminating the need for temporary fixation by conventional screws and subsequent removal of the screws prior to installing wallboard. Although not explicitly shown, it will be understood that conventional strengthening features such as ribs can be integrated into portions of the clip 100 as needed, especially to strengthen the flanges 104, 105.

In one embodiment, each end portion 102, 103 has an extension tab 108 extending inwardly perpendicular from the interior surface of the end portions 102, 103 to improve the sliding and engagement function of the structural members 200.

Another feature of the clip 100 is the unitary construction. Forming the clip 100 out of single piece of metal increases its strength and decreases production costs.

It is clear that the present invention is well suited to perform better than current deflection clips due to the advantages mentioned herein. While a present embodiment of the invention has been described for the purposes of disclosure, it will be understood that numerous changes may be made in the construction, operation, and arrangement of the various elements without departing from the spirit and scope of the invention as defined in the following claims.

The invention claimed is:

1. A deflection clip securing with an associated wall stud and an associated track that receives a first end of the associated wall stud, the clip comprising:

a substantially planar base having a first inside surface, a first outside surface, a first end, and a second end;

a first end portion extending perpendicular from the first inside surface of the base at the first end of the base, the portion having a first superior surface, a first inferior surface, a second inside surface and a second outside surface;

a first flange extending outwardly away from the first inferior surface of the first end portion;

at least one barb extending outward from the first flange;

a second end portion extending perpendicular from the first inside surface of the base at the second end of the base, the portion having a second superior surface, a second inferior surface, a third inside surface and a third outside surface;

a second flange extending outwardly away from the second inferior surface of the second end portion; and at least one barb extending outward from the second flange, wherein the at least one barb extending from the first flange and the at least one barb extending from the second flange connect by friction-fitting to inner walls of the associated track, and wherein the associated wall stud passes through a space defined by the second inside surface of the first end portion, the first inside surface of the base, and the third inside surface of the second end portion.

2. The clip of claim 1 wherein a number of barbs on each flange is less than five.

3. The clip of claim 2 wherein the deflection clip is made from light gauge steel.

4. The clip of claim 1 wherein the barbs are resiliently deformable.

5. The clip of claim 4 wherein the first end portion and the second end portion contain extension tabs perpendicular to the flanges and essentially parallel to the base, wherein a first extension tab of the first end portion extends from the first end portion in a direction toward the second end portion, and wherein a second extension tab of the second end portion extends from the second end portion in a direction toward the first end portion.

6. The clip of claim 5 wherein the deflection clip is manufactured from one flat integral piece of material.

7. The clip of claim 5 wherein the deflection clip is made from a resiliently deformable material.

8. The clip of claim 7 wherein the resilient material is light gauge steel.

* * * * *